US006712651B2

(12) United States Patent
Kanno

(10) Patent No.: US 6,712,651 B2
(45) Date of Patent: Mar. 30, 2004

(54) FUEL INJECTION CONTROL FOR MARINE ENGINE

(75) Inventor: Isao Kanno, Hamamatsu (JP)

(73) Assignee: Yamaha Marine Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 10/113,922

(22) Filed: Mar. 29, 2002

(65) Prior Publication Data

US 2002/0151229 A1 Oct. 17, 2002

(30) Foreign Application Priority Data

Apr. 11, 2001 (JP) ..... 2001-112642
Sep. 21, 2001 (JP) ..... 2001-288524

(51) Int. Cl.[7] ..... B63H 21/38

(52) U.S. Cl. ..... 440/1; 440/88 F; 440/88 L; 123/196 S

(58) Field of Search ..... 440/1, 88, 88 F, 440/88 L; 123/196 S

(56) References Cited

U.S. PATENT DOCUMENTS 3,841,291 A * 10/1974 Ludewig et al. ..... 123/198 DB
3,893,108 A * 7/1975 McBride et al. ..... 340/507
4,019,489 A * 4/1977 Cartmill ..... 123/198 D
4,913,108 A 4/1990 Sougawa et al.
5,070,832 A * 12/1991 Hapka et al. ..... 123/198 D
5,555,857 A 9/1996 Kanno
5,669,349 A 9/1997 Iwata et al.
5,903,215 A 5/1999 Kanno
6,113,442 A 9/2000 Nakamura
6,131,539 A * 10/2000 Thomas ..... 123/41.15
6,148,777 A 11/2000 Motose et al.
6,213,820 B1 * 4/2001 Kanno ..... 440/1

OTHER PUBLICATIONS

Co–pending patent application: Ser. No. 09/311,184, filed May 13, 1999, entitled Lubrication System Malfunction Warning System for Marine Propulsion Units, in the name of Akihoko Hoshiba, Yasuo Suganama and assigned to Sanshin Kogyo Kabushiki Kaisha.

Co–pending patent application: Ser. No. 09/711,427, filed Nov. 13, 2000, entitled Engine Lubrication Oil Alarm System, in the name of Isao Kanno and assigned to Sanshin Kogyo Kabushiki Kaisha.

Co–pending U.S. patent application No. 09/311,184, filed May 13, 1999, titled "Lubrication System Malfunction Warning System For Marine Propulsion Units".

Co–pending U.S. patent application No. 09/711,427, filed Nov. 13, 2000, titled "Engine Lubrication Oil Alarm System".

* cited by examiner

*Primary Examiner*—Sherman Basinger
(74) *Attorney, Agent, or Firm*—Knobbe, Martens, Olson & Bear, LLP

(57) ABSTRACT

A watercraft includes an engine having a fuel injection system. The fuel injection system is controlled to gradually reduce a speed of the engine if a lubrication pressure detected within the engine is below a predetermined pressure. Additionally, the fuel injection system is controlled to maintain a reduced engine speed until the throttle lever is moved to a position corresponding to a lower speed.

18 Claims, 13 Drawing Sheets

FUEL INJECTION CONTROL FOR MARINE ENGINE

This application is based on and claims priority to Japanese Patent Applications No. 2001-112642, filed Apr. 11, 2001 and No. 2001-288524, filed Sep. 21, 2001 the entire contents of which is hereby expressly incorporated by reference.

BACKGROUND OF THE INVENTION

The present application generally relates to an engine control arrangement for controlling a four-stroke watercraft, and more particularly to an engine management system that warns the user of abnormal oil pressures.

DESCRIPTION OF THE RELATED ART

Watercraft, including personal watercraft and jet boats, are often powered by an internal combustion engine having an output shaft arranged to drive a water propulsion device. Occasionally, due to their sporting nature, such watercraft can be operated at planning speeds.

Watercraft often operate within three modes of operation: displacement mode, transition mode and planing mode. During lower speeds, the hull displaces water to remain buoyant; this is the displacement mode. At a particular watercraft speed relative to the water, a portion of the hull rises up from the water and the watercraft begins planing across the water; this is the planing mode. Of course, the transition mode occurs between the displacement mode and the planing mode and involves the range of watercraft speeds that cause a transition between the planing and displacement modes.

Importantly, while the watercraft is planing (i.e., up on plane), the wetted surface area of the watercraft is decreased and the water resistance is substantially reduced. It is during this mode of operation that the watercraft is most often used and the engine is under its most demanding conditions. Oil pressure being vital to the engine operation, should be carefully monitored in order to advise the operator of any lubrication problems.

Certain known oil pressure warning systems set a single threshold for a minimum oil pressure. These types of single low pressure warning systems are set to warn the user when the oil pressure falls below a predetermined value. This predetermined value can be too low and thus fails to provide adequate warning when an engine loses oil pressure at high engine speeds because a dangerously low oil pressure for high engine speeds could still be above the predetermined low oil pressure warning threshold.

Other oil pressure warning systems set the predetermined critical oil pressure value too high to warn the user against a loss of oil pressure at high engine speeds. As a result a warning is falsely communicated to the user when the oil pressure value drops below this predetermined value even though the engine is operating at a lower speed with a low, yet safe oil pressure.

SUMMARY OF THE INVENTION

Accordingly, an engine control arrangement has been developed to accurately warn the user of low oil pressure during all speeds of engine operation. The oil pressure warning system is able to determine which oil pressure threshold is appropriate and accurately warns the user when a low oil pressure corresponding to the current watercraft speed is present. A low oil pressure warning system that can adapt to both low and high engine speed characteristics is beneficial in providing the user with a safer, more enjoyable recreational experience.

One aspect of the present invention includes the realization that a sudden automatic decrease in engine speed during operation of a watercraft, can make the operator and passengers uncomfortable. For example, if a watercraft includes a control system which automatically reduces engine speed while the operator is holding the throttle lever at a position corresponding to an elevated watercraft speed, the sudden decrease in watercraft speed can make the operator and any passengers feel uncomfortable. Additionally, if the control system automatically restores engine power, the watercraft can suddenly accelerate, which can also make the operator and any passengers feel uncomfortable.

Thus, another aspect of the present invention is directed to a watercraft comprising a hull with an engine disposed within the hull. The engine includes an engine body defining at least one combustion chamber therein. A fuel delivery system is configured to deliver fuel to the engine body for combustion within the combustion chamber. A lubrication system is configured to circulate lubricant through the engine body. A lubricant pressure sensor is configured to detect a pressure within the lubrication system. Additionally, an engine speed sensor is configured to detect a speed of the engine. The watercraft also includes a controller connected to the lubricant pressure sensor, the engine speed sensor, and the fuel delivery system. The controller is configured to gradually reduce the speed of the engine if the lubricant pressure is below a predetermined pressure.

A further aspect of the present invention is directed to a watercraft having a hull and an engine disposed within the hull. A lubrication system is configured to circulate lubricant through the engine. A lubricant pressure sensor is configured to detect a pressure within the lubrication system. An engine speed sensor is configured to detect a speed of the engine. The watercraft also includes a controller configured to decrease engine speed if the lubricant pressure is below a predetermined pressure. The user controls the power output of the engine with an engine load input device. The controller is configured to continue to operate the engine at a reduced engine speed until the engine load input device is moved to position corresponding to an engine load that is below a predetermined engine load.

BRIEF DESCRIPTION OF THE DRAWINGS

The foregoing features, aspects, and advantages of the present invention will now be described with reference to the drawings of a preferred embodiment that is intended to illustrate and not to limit the invention. The drawings comprise fourteen figures in which.

DETAILED DESCRIPTION OF THE PREFERRED EMBODIMENT

With reference to FIGS. 1 to 6, an overall configuration of a personal watercraft 10 and its engine 12 is described below. The watercraft 10 employs the internal combustion engine 12, which is configured in accordance with a preferred embodiment of the present invention. The described engine configuration and the associated control routine have particular utility for use with personal watercraft, and thus, are described in the context of personal watercraft. The engine configuration and the control routine, however, also can be applied to other types of watercraft, such as, for example, small jet boats and other vehicles.

Figure 1:
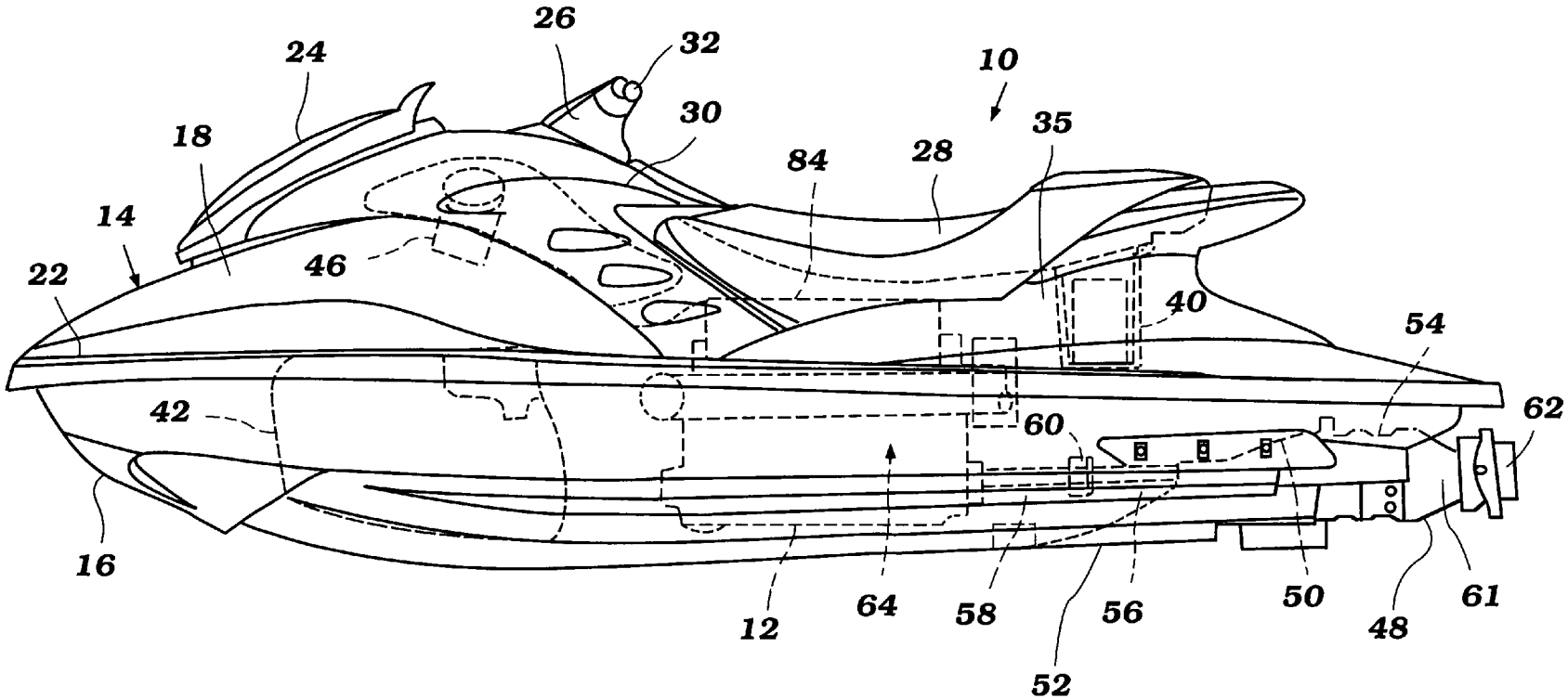
FIG. 1 is a side elevational view of a personal watercraft of the type powered by an engine controlled in accordance with certain features, aspects and advantages of the present invention. Several of the internal components of the watercraft (e.g., the engine) are illustrated in phantom.

With reference initially to FIG. 1, the personal watercraft 10 includes a hull 14 formed with a lower hull section 16 and an upper hull section or deck 18. The lower hull section 16 and the upper hull section 18 preferably are coupled together to define an internal cavity 20 (see FIG. 5). A bond flange 22 defines an intersection of both of the hull sections 16, 18 and a portion of a gunwale that extends around a portion of the periphery of the hull 14.

The illustrated upper hull section 18 preferably comprises a hatch cover 24, a control mast 26 and a seat 28, which are arranged generally in seriatim from fore to aft.

In the illustrated arrangement, a forward portion of the upper hull section 18 defines a bow portion 30 that slopes upwardly. An opening can be provided through the bow portion 30 so the rider can access the internal cavity 20. The hatch cover 24 can be detachably affixed (e.g., hinged) to the bow portion 30 to resealably cover the opening.

The control mast 26 extends upwardly to support a handle bar 32. The handle bar 32 is provided primarily for controlling the direction of the watercraft 10. The handle bar 32 preferably carries other mechanisms, such as, for example, a throttle lever 34 that is used to control the engine output (i.e., to vary the engine speed).

The seat 28 extends rearwardly from a portion just rearward of the bow portion 30. The seat 28 is disposed atop a pedestal 35 defined by the deck 18 (see FIG. 1). In the illustrated arrangement, the seat 28 has a saddle shape. Hence, a rider can sit on the seat 28 in a straddle fashion.

Foot areas 36 are defined on both sides of the seat 28 along a portion of the top surface of the upper hull section 18. The foot areas 36 are formed generally flat but may be inclined toward a suitable drain configuration.

The seat 28 preferably is configured to close an access opening 38 formed within the pedestal 35. The access opening 38 generally provides suitable access to the internal cavity 20 and, in the illustrated arrangement, to the engine 12. Thus, when the seat 28 is removed from the pedestal 35, the engine 12 can be accessed through the opening 38. In the illustrated embodiment, the upper hull section 18 or pedestal 35 also encloses a storage box 40 that is disposed under the seat 28.

A fuel tank 42 is positioned in the cavity 20 under the bow portion 30 of the upper hull section 18 in the illustrated arrangement. A duct (not shown) preferably couples the fuel tank 42 with a fuel inlet port positioned at a top surface of the bow 30 of the upper hull section 18. A closure cap 44 (see FIG. 2) closes the fuel inlet port to inhibit water infiltration.

The engine 12 is disposed in an engine compartment defined, for instance within the cavity 20. The engine compartment preferably is located under the seat 28, but other locations are also possible (e.g., beneath the control mast or in the bow). In general, the engine compartment is defined within the cavity 20 by a forward and rearward bulkhead. Other configurations, however, are possible.

A pair of air ducts 46 are provided in the illustrated arrangement such that the air within the internal cavity 20 can be readily replenished or exchanged. The engine compartment, however, is substantially sealed to protect the engine 12 and other internal components from water.

A jet pump unit 48 propels the illustrated watercraft 10. Other types of marine drives can be used depending upon the application. The jet pump unit 48 preferably is disposed within a tunnel 50 formed on the underside of the lower hull section 16. The tunnel 50 has a downward facing inlet port 52 opening toward the body of water. A jet pump housing 54 is disposed within a portion of the tunnel 50. Preferably, an impeller (not shown) is supported within the jet pump housing 54.

An impeller shaft 56 extends forwardly from the impeller and is coupled with a crankshaft 58 of the engine 12 by a suitable coupling device 60. The crankshaft 58 of the engine 12 thus drives the impeller shaft 56. The rear end of the housing 54 defines a discharge nozzle 61. A steering nozzle 62 is affixed proximate the discharge nozzle 61. The steering nozzle 62 can be pivotally moved about a generally vertical steering axis. The steering nozzle 62 is connected to the handle bar 32 by a cable or other suitable arrangement so that the rider can pivot the nozzle 62 for steering the watercraft.

Figure 5:
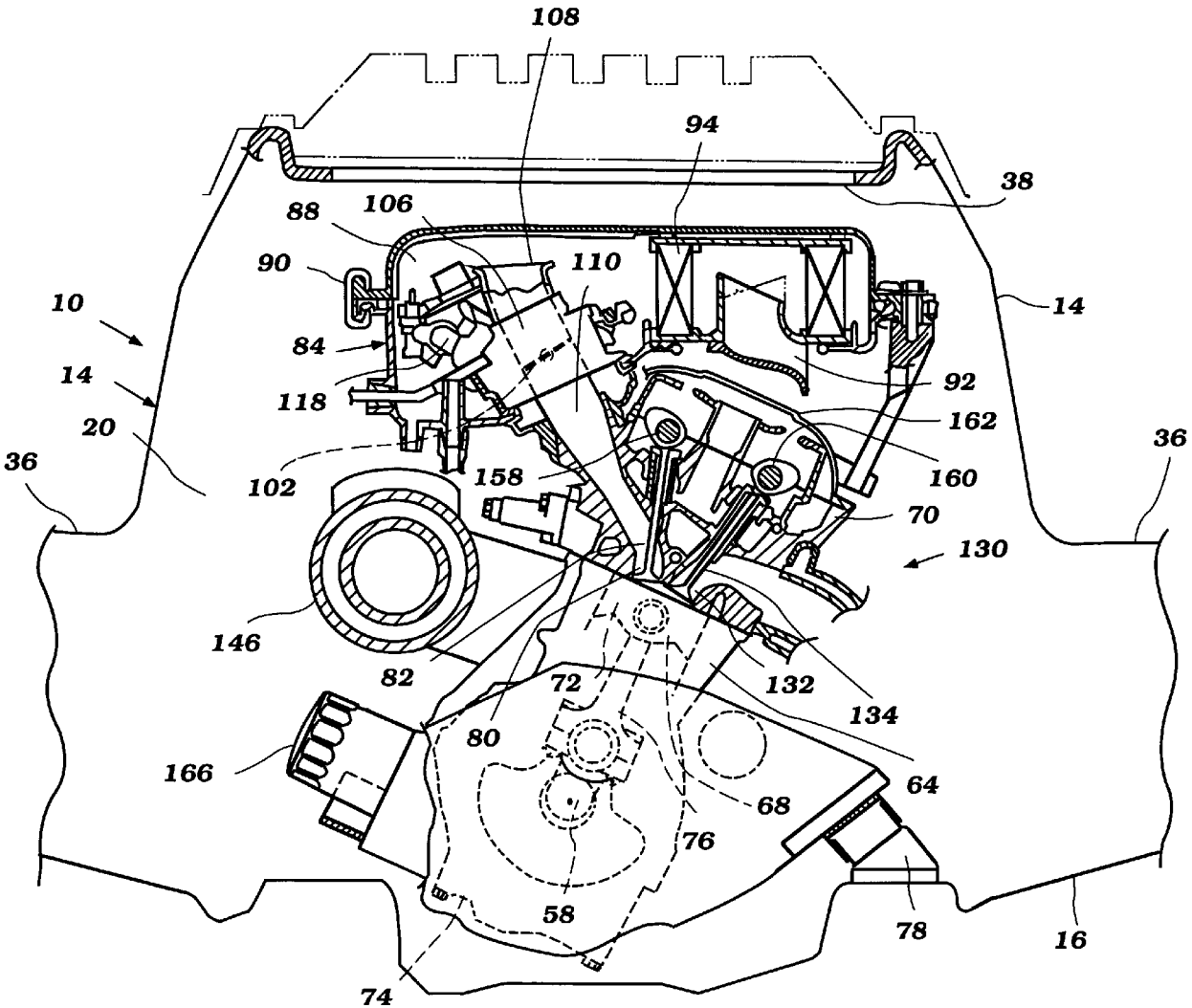
FIG. 5 is a schematic, cross-sectional rear view of the watercraft and the engine. A profile of a hull of the watercraft is shown schematically. Portions of the engine and an opening of an engine compartment of the hull are illustrated partially in section.

The engine 12 in the illustrated arrangement operates on a four-stroke cycle combustion principal. With reference to FIG. 5, the engine 12 includes a cylinder block 64 with four cylinder bores 66 formed side by side. The engine 12, thus, is an inclined L4 (in-line four cylinder) type. The illustrated engine, however, merely exemplifies one type of engine on which various aspects and features of the present invention can be used. Engines having a different number of cylinders, other cylinder arrangements, other cylinder orientations (e.g., upright cylinder banks, V-type, and W-type), and operating on other combustion principles (e.g., crankcase compression two-stroke, diesel, and rotary) are all practicable. Many orientations of the engine are also possible (e.g., with a transversely or vertically oriented crankshaft).

With continued reference to FIG. 5, a piston 68 reciprocates in each of the cylinder bores 66 formed within the cylinder block 64. A cylinder head member 70 is affixed to the upper end of the cylinder block 64 to close respective upper ends of the cylinder bores 66. The cylinder head member 70, the cylinder bores 66 and the pistons 68 together define combustion chambers 72.

A lower cylinder block member or crankcase member 74 is affixed to the lower end of the cylinder block 64 to close the respective lower ends of the cylinder bores 66 and to define, in part, a crankshaft chamber. The crankshaft 58 is journaled between the cylinder block 64 and the lower cylinder block member 74. The crankshaft 58 is rotatably connected to the pistons 68 through connecting rods 76. Preferably, a crankshaft speed sensor 77 is disposed proximate the crankshaft to output a signal indicative of engine speed. In some configurations, the crankshaft speed sensor 77 is formed, at least in part, with a flywheel magneto. The speed sensor 77 also can output crankshaft position signals in some arrangements.

The cylinder block 64, the cylinder head member 70 and the crankcase member 74 together generally define an engine block of the engine 12. The engine 12 preferably is made of an aluminum-based alloy.

Engine mounts 78 preferably extend from both sides of the engine 12. The engine mounts 78 can include resilient portions made of, for example, a rubber material. The engine 12 preferably is mounted on the lower hull section 16, specifically, a hull liner, by the engine mounts 78 so that the engine 12 is greatly inhibited from conducting vibration energy to the hull section 16.

The engine 12 preferably includes an air induction system to guide air to the combustion chambers 72. In the illustrated embodiment, the air induction system includes four air intake ports 80 defined within the cylinder head member 70. The intake ports 80 communicate with the four combustion chambers 72, respectfully. Other numbers of ports can be used depending upon the application.

Intake valves 82 are provided to open and close the intake ports 80 such that flow through the ports 80 can be controlled. A camshaft arrangement that can be used to control the intake valves 82 is discussed below.

The air induction system also includes an air intake box 84 for smoothing intake airflow and acting as an intake silencer. The intake box 84 in the illustrated embodiment is generally rectangular and, along with an intake box cover 86, defines a plenum chamber 88. The intake box cover 86 can be attached to the intake box 84 with a number of intake box cover clips 90 or any other suitable fastener. Other shapes of the intake box of course are possible, but the plenum chamber preferably is as large as possible while still allowing for positioning within the space provided in the engine compartment.

Figure 6:
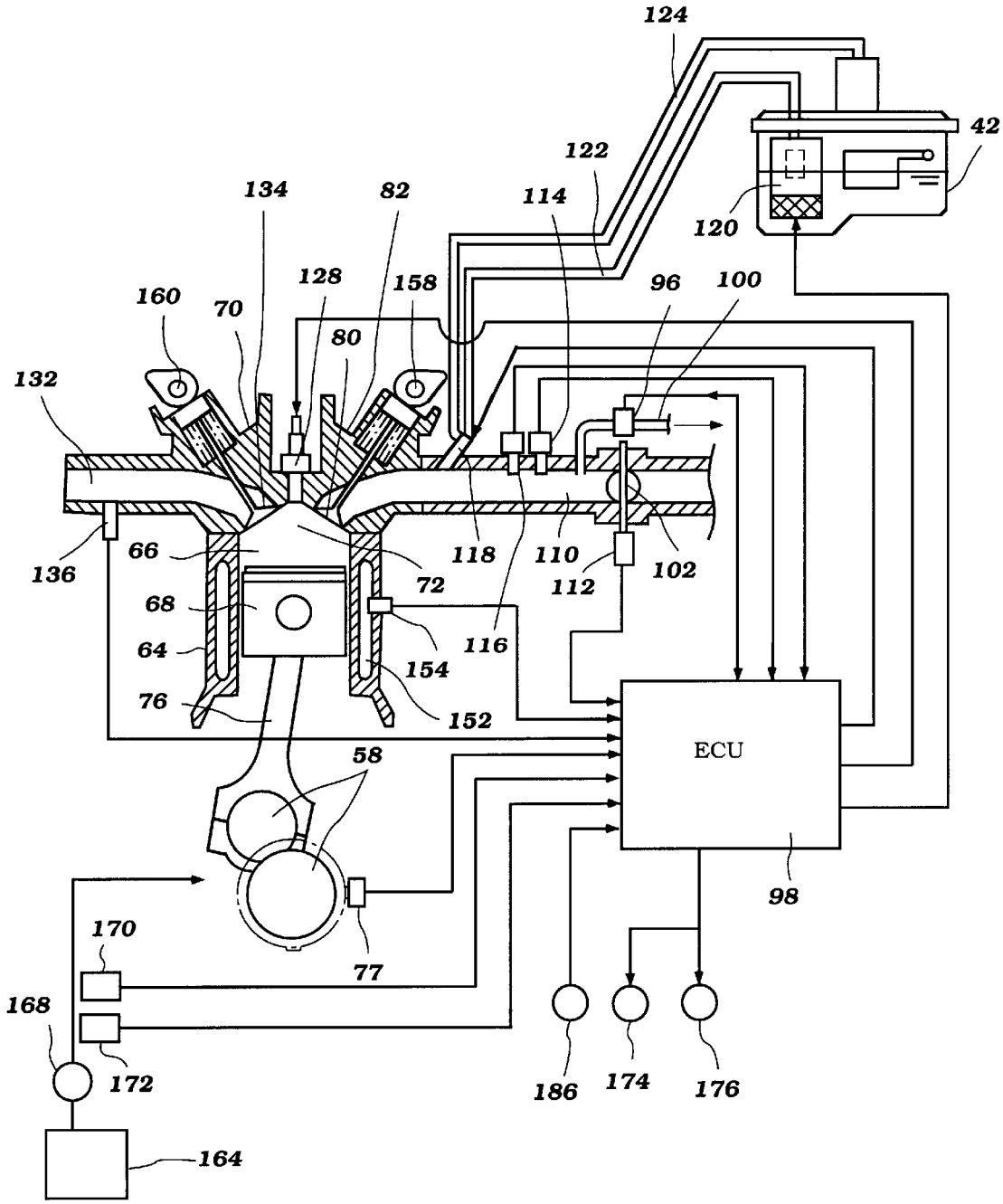
FIG. 6 is a schematic view showing the engine control system, including at least a portion of the engine in cross-section, an ECU, and a simplified fuel injection system.

With reference now to FIG. 5, in the illustrated arrangement, air is introduced into the plenum chamber 88 through a pair of airbox inlet ports 92 and a filter 94. With reference to FIG. 6, the illustrated air induction system preferably also includes an idle speed control device (ISC) 96 that may be controlled by an Electronic Control Unit (ECU) 98 discussed in greater detail below.

In one advantageous arrangement, the ECU 98 is a microcomputer that includes a micro-controller having a CPU, a timer, RAM, and ROM. Of course, other suitable configurations of the ECU also can be used. Preferably, the ECU 98 is configured with or capable of accessing various maps to control engine operation in a suitable manner.

In general, the ISC device 96 comprises an air passage 100 that bypasses a throttle valve assembly 102. Air flow through the air passage 100 of the ISC device 96 preferably is controlled with a suitable valve (not shown), which may be a needle valve or the like. In this manner, the air flow amount can be controlled in accordance with a suitable control routine, one of which is discussed below.

Throttle bodies 106 slant downwardly toward the port side relative to the center axis of the engine 12. Respective top ends 108 of the throttle bodies 106, in turn, open upwardly within the plenum chamber 88. Air in the plenum chamber 88 thus is drawn through the throttle bodies 106, through individual intake passages 110 and the intake ports 80 into the combustion chambers 72 when negative pressure is generated in the combustion chambers 72. The negative pressure is generated when the pistons 68 move toward the bottom dead center position from the top dead center position during the intake stroke.

With reference to FIG. 6, a throttle valve position sensor 112 preferably is arranged proximate the throttle valve assembly 102 in the illustrated arrangement. The sensor 112 preferably generates a signal that is representative of either absolute throttle position or movement of the throttle shaft. Thus, the signal from the throttle valve position sensor 112 corresponds generally to the engine load, as may be indicated by the degree of throttle opening. In some applications, a manifold pressure sensor 114 can also be provided to detect engine load. Additionally, an induction air temperature sensor 116 can be provided to detect induction air temperature. The signal from the sensors 112, 114, 116 can be sent to the ECU 98 via respective data lines. These signals, along with other signals, can be used to control various aspects of engine operation, such as, for example, but without limitation, fuel injection amount, fuel injection timing, ignition timing, ISC valve positioning and the like.

The engine 12 also includes a fuel injection system which preferably includes four fuel injectors 118, each having an injection nozzle exposed to the intake ports 80 so that injected fuel is directed toward the combustion chambers 72. Thus, in the illustrated arrangement, the engine 12 features port fuel injection. It is anticipated that various features, aspects and advantages of the present invention also can be used with direct or other types of indirect fuel injection systems.

With reference again to FIG. 6, fuel is drawn from the fuel tank 42 by a fuel pump 120, which is controlled by the ECU 98. The fuel is delivered to the fuel injectors 118 through a fuel delivery conduit 122. A fuel return conduit 124 also is provided between the fuel injectors 118 and the fuel tank 42. Excess fuel that is not injected by the fuel injector 118 returns to the fuel tank 42 through the conduit 124. The flow generated by the return of the unused fuel from the fuel injectors aids in cooling the fuel injectors.

In operation, a predetermined amount of fuel is sprayed into the intake ports 80 via the injection nozzles of the fuel injectors 118. The timing and duration of the fuel injection is dictated by the ECU 98 based upon any desired control strategy. In one presently preferred configuration, the amount of fuel injected is based upon the sensed throttle valve position and the sensed manifold pressure, depending on the state of engine operation. The fuel charge delivered by the fuel injectors 118 then enters the combustion chambers 72 with an air charge when the intake valves 82 open the intake ports 80.

The engine 12 further includes an ignition system. In the illustrated arrangement, four spark plugs 128 are fixed on the cylinder head member 70. The electrodes of the spark plugs 128 are exposed within the respective combustion chambers 72. The spark plugs 128 ignite an air/fuel charge just prior to, or during, each power stroke, preferably under the control of the ECU 98 to ignite the air/fuel charge therein.

The engine 12 further includes an exhaust system 130 to discharge burnt charges, i.e., exhaust gases, from the combustion chambers 72. In the illustrated arrangement, the exhaust system 130 includes four exhaust ports 132 that generally correspond to, and communicate with, the combustion chambers 72. The exhaust ports 132 preferably are defined in the cylinder head member 70. Exhaust valves 134 preferably are provided to selectively open and close the exhaust ports 132. A suitable exhaust cam arrangement, such as that described below, can be provided to operate the exhaust valves 134.

A combustion condition or oxygen sensor 136 preferably is provided to detect the in-cylinder combustion conditions by sensing the residual amount of oxygen in the combustion products at a point in time very close to when the exhaust port is opened. The signal from the oxygen sensor 136 preferably is delivered to the ECU 98. The oxygen sensor 136 can be disposed within the exhaust system at any suitable location. In the illustrated arrangement, the oxygen sensor 136 is disposed proximate the exhaust port 132 of a single cylinder. Of course, in some arrangements, the oxygen sensor can be positioned in a location further downstream; however, it is believed that more accurate readings result from positioning the oxygen sensor upstream of a merge location that combines the flow of several cylinders.

Figure 3:
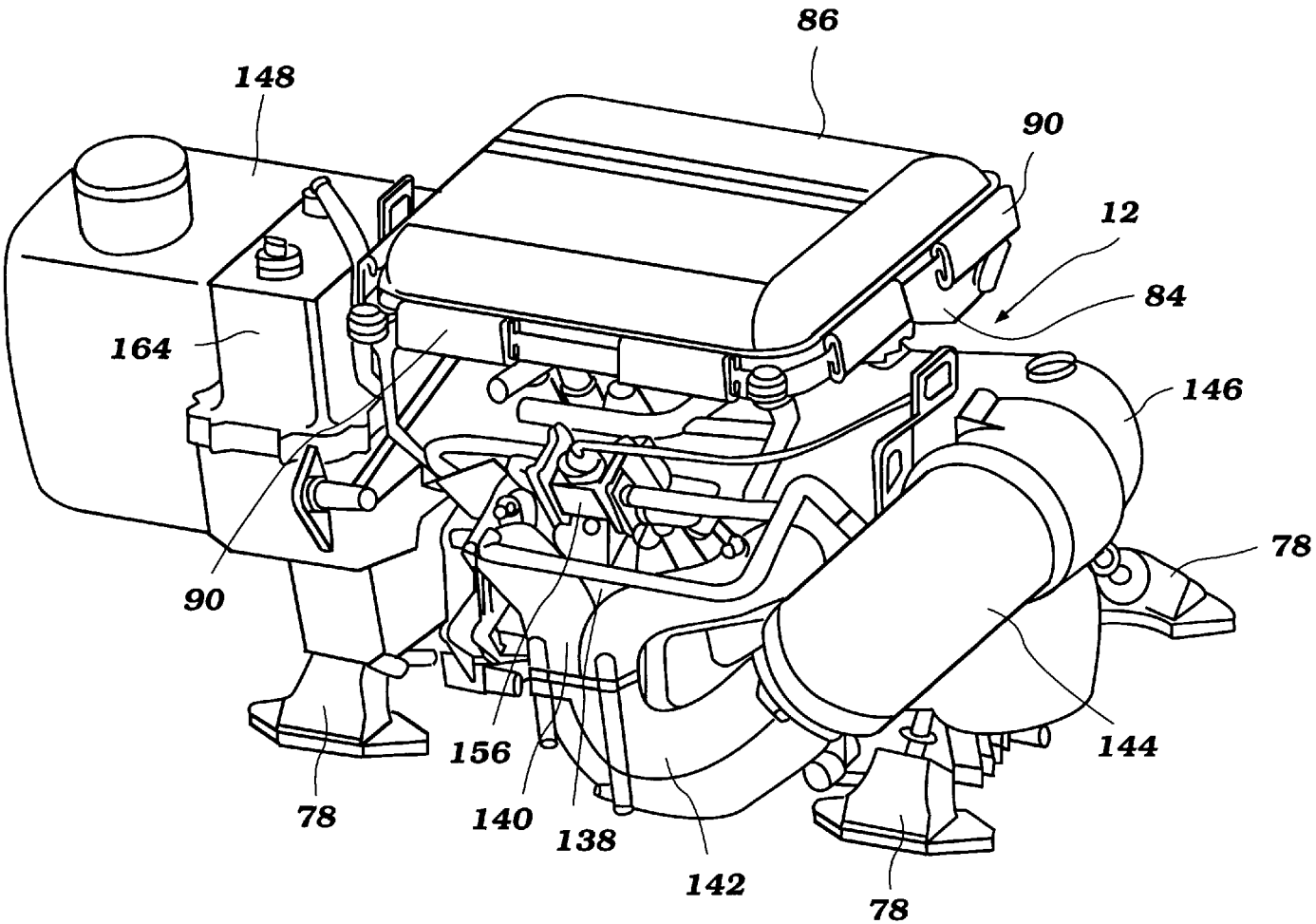
FIG. 3 is a front, starboard, and top perspective view of the engine removed from the watercraft illustrated in FIG. 1.

With reference now to FIG. 3, the illustrated exhaust system 130 preferably includes two small exhaust manifolds 138, 140 that each receive exhaust gases from a pair of exhaust ports 132 (i.e., a pair of cylinders). The respective downstream ends of the exhaust manifolds 138, 140 are coupled with a first unitary exhaust conduit 142. The first unitary conduit 142 is further coupled with a second unitary exhaust conduit 144. The second unitary conduit 144 is coupled with an exhaust pipe 146 at a location generally forward of the engine 12.

Figure 2:
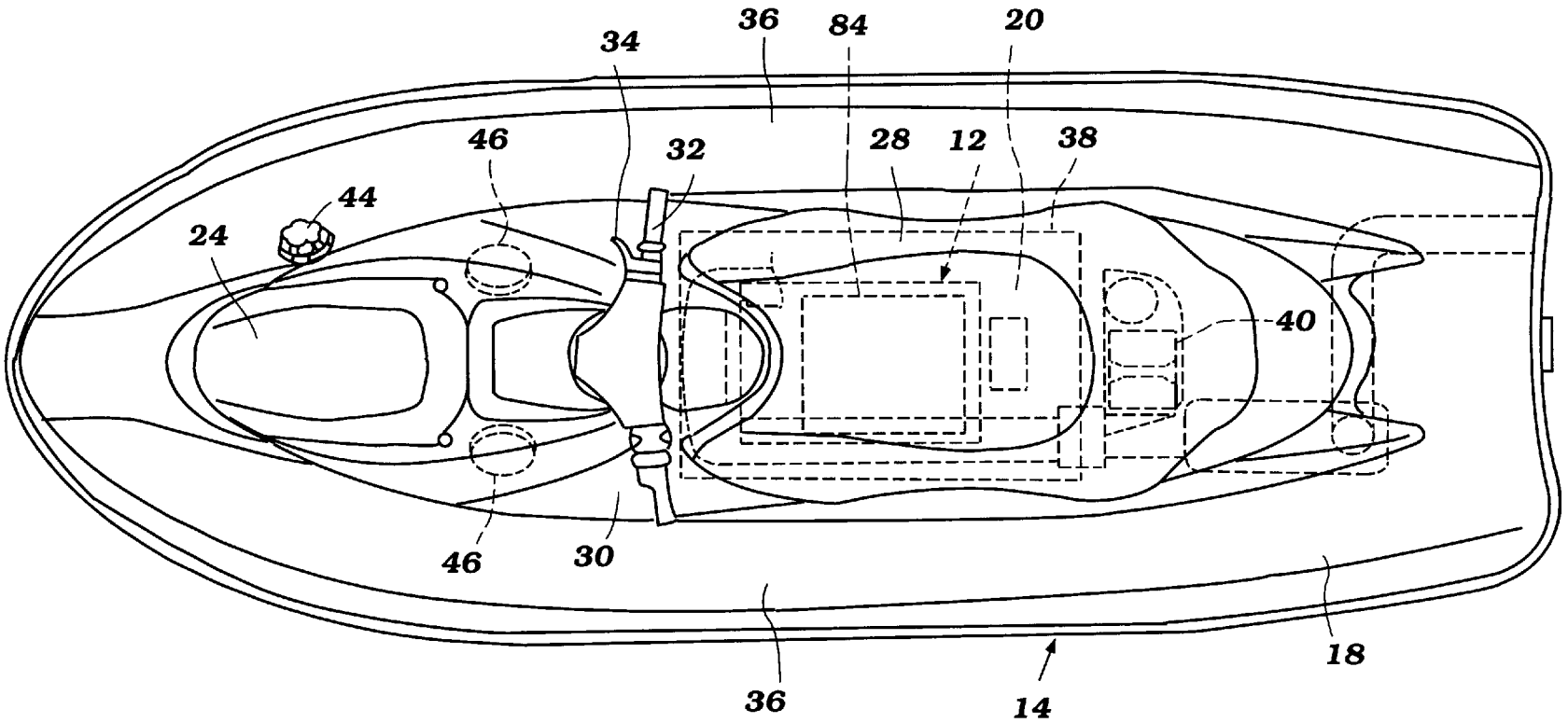
FIG. 2 is a top plan view of the watercraft of FIG. 1.

The exhaust pipe 146 extends rearwardly along a port side surface of the engine 12. The exhaust pipe 146 is connected to a water-lock 148 proximate a forward surface of the water-lock 148. With reference to FIG. 2, a discharge pipe 150 extends from a top surface of the water-lock 148. The discharge pipe 150 bends transversely across the center plane and rearwardly toward a stern of the watercraft. Preferably, the discharge pipe 150 opens at a stern of the lower hull section 16 in a submerged position. As is known, the water-lock 148 generally inhibits water in the discharge pipe 150 or the water-lock itself from entering the exhaust pipe 146.

The engine 12 further includes a cooling system configured to circulate coolant into thermal communication with at least one component within the watercraft 10. Preferably, the cooling system is an open-loop type of cooling system that circulates water drawn from the body of water in which the watercraft 10 is operating through thermal communication with heat generating components of the watercraft 10 and the engine 12. It is expected that other types of cooling systems can be used in some applications. For instance, in some applications, a closed-loop type liquid cooling system can be used to cool lubricant and other components.

The present cooling system preferably includes a water pump arranged to introduce water from the body of water surrounding the watercraft 10. The jet propulsion unit preferably is used as the water pump with a portion of the water pressurized by the impeller being drawn off for use in the cooling system, as is generally known in the art. Preferably, water jackets 152 can be provided around portions of the cylinder block 64 and the cylinder head member 70 (see FIG. 6).

In some applications, the exhaust system 130 is comprised of a number of double-walled components such that coolant can flow between the two walls (i.e., the inner and outer wall) while the exhaust gases flow within a lumen defined by the inner wall. Such constructions are well known.

An engine coolant temperature sensor 154 preferably is positioned to sense the temperature of the coolant circulating through the engine. Of course, the sensor 154 could be used to detect the temperature in other regions of the cooling system; however, by sensing the temperature proximate the cylinders of the engine, the temperature of the combustion chamber and the closely positioned portions of the induction system is more accurately reflected.

With reference again to FIG. 3, the engine 12 preferably includes a secondary air supply system that supplies air from the air induction system to the exhaust system 130. Hydrocarbon (HC) and carbon monoxide (CO) components of the exhaust gases can be removed by an oxidation reaction with oxygen ($O_2$) that is supplied to the exhaust system 130 from the air induction system. In one arrangement of the secondary air supply system, a secondary air supply device 156 is disposed next to the cylinder head member 70 on the starboard side. The air supply device 156 defines a generally closed cavity and contains a control valve in the illustrated arrangement. Air supplied from the air supply device 156 passes directly to the exhaust system 130 when the engine 12 is operating in a relatively high speed range and/or under a relatively high load condition because greater amounts of hydrocarbon (HC) and carbon monoxide (CO) are more likely to be present in the exhaust gases under such a condition.

With reference to FIGS. 5 and 6, the engine 12 preferably has a valve cam mechanism for actuating the intake and exhaust valves 82, 134. In the illustrated embodiment, a double overhead camshaft drive is employed. That is, an intake camshaft 158 actuates the intake valves 82 and an exhaust camshaft 160 separately actuates the exhaust valves 134. The intake camshaft 158 extends generally horizontally over the intake valves 82 from fore to aft, and the exhaust camshaft 160 extends generally horizontally over the exhaust valves 134 also from fore to aft.

Both the intake and exhaust camshafts 158, 160 are journaled in the cylinder head member 70 in any suitable manner. A cylinder head cover member 162 extends over the camshafts 158, 160, and is affixed to the cylinder head member 70 to define a camshaft chamber. The secondary air supply device 156 is preferably affixed to the cylinder head cover member 162. Additionally, the air supply device 156 is desirably disposed between the intake air box and the engine 12.

The intake camshaft 158 has cam lobes each associated with the respective intake valves 82, and the exhaust camshaft 160 also has cam lobes associated with respective exhaust valves 134. The intake and exhaust valves 82, 134 normally close the intake and exhaust ports 80, 132 by a biasing force of springs. When the intake and exhaust camshafts 158, 160 rotate, the cam lobes push the respective valves 82, 134 to open the respective ports 80, 132 by overcoming the biasing force of the spring. Air enters the combustion chambers 72 when the intake valves 82 open. In the same manner, the exhaust gases exit from the combustion chambers 72 when the exhaust valves 134 open.

The crankshaft 58 preferably drives the intake and exhaust camshafts 158, 160. The respective camshafts 158, 160 have driven sprockets affixed to ends thereof while the crankshaft 58 has a drive sprocket. Each driven sprocket has a diameter that is twice as large as a diameter of the drive sprocket. A timing chain or belt is wound around the drive and driven sprockets. When the crankshaft 58 rotates, the drive sprocket drives the driven sprockets via the timing chain, and thus the intake and exhaust camshafts 158, 160 also rotate.

Figure 4:
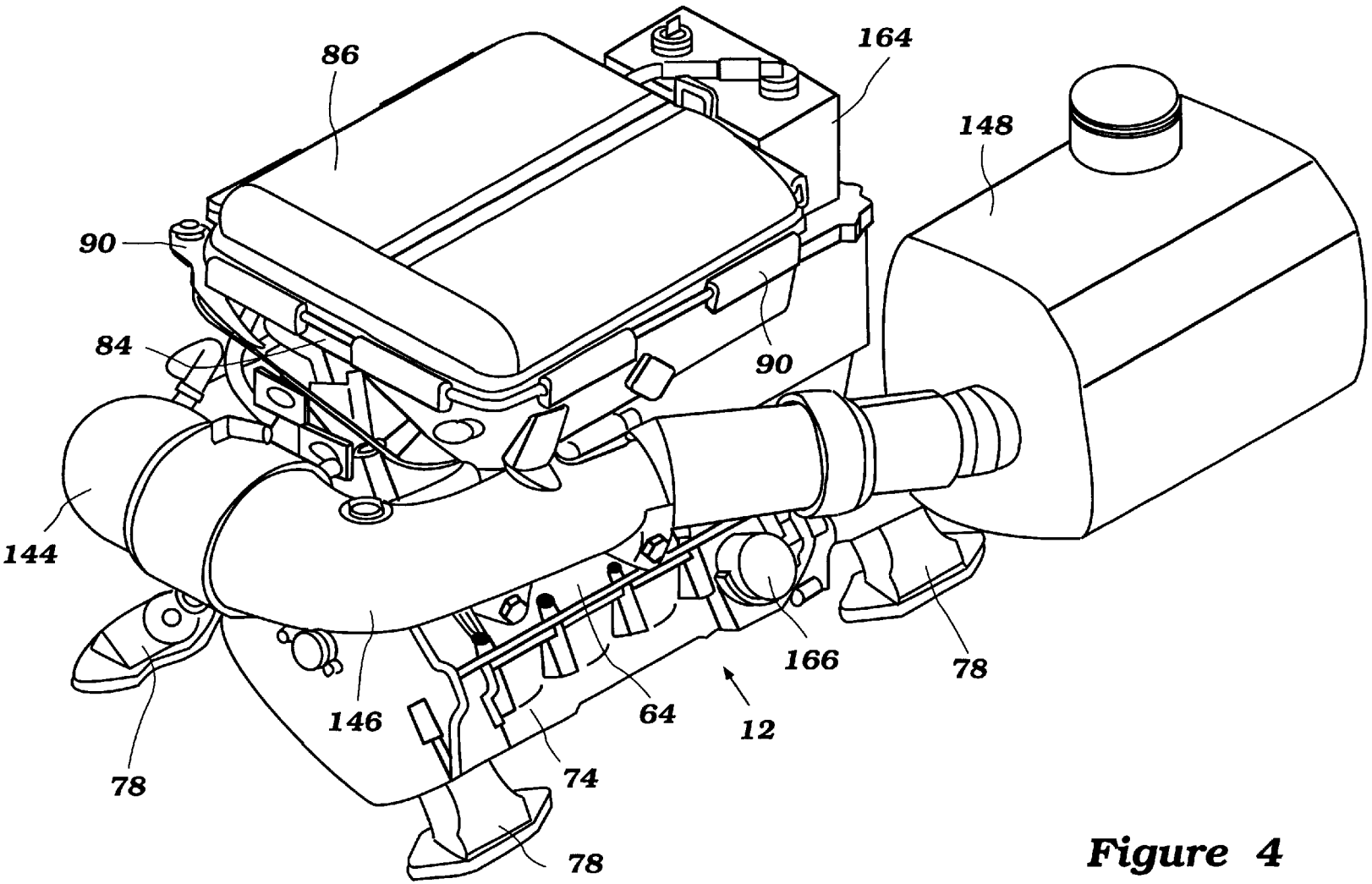
FIG. 4 is a front, port, and top perspective view of the engine removed from the watercraft illustrated in FIG. 1.

The engine 12 preferably includes a lubrication system that delivers lubricant oil to engine portions for inhibiting frictional wear of such portions. In the illustrated embodiment, a dry-sump lubrication system is employed. This system is a closed-loop type and includes an oil reservoir 164, as illustrated in FIGS. 3 and 4.

An oil delivery pump is provided within a circulation loop to deliver the oil in the reservoir 164 through an oil filter 166 to the engine portions that are to be lubricated, for example, but without limitation, the pistons 68 and the crankshaft bearings (not shown). The crankshaft 58 or one of the camshafts 158,160 preferably drives the delivery and return pumps.

In order to determine appropriate engine operation control scenarios, the ECU 98 preferably uses control maps and/or indices stored within the ECU 98 in combination with data collected from various input sensors. The ECU's various input sensors can include, but are not limited to, the throttle position sensor 112, the manifold pressure sensor 114, the engine coolant temperature sensor 154, the oxygen ($O_2$) sensor 136, and a crankshaft speed sensor 77.

It should be noted that the above-identified sensors merely correspond to some of the sensors that can be used for engine control and it is, of course, practicable to provide other sensors, such as an intake air pressure sensor, an intake air temperature sensor, a knock sensor, a neutral sensor, a watercraft pitch sensor, a shift position sensor and an atmospheric temperature sensor. The selected sensors can be provided for sensing engine running conditions, ambient conditions or other conditions of the engine 12 or associated watercraft 10.

Figure 7:
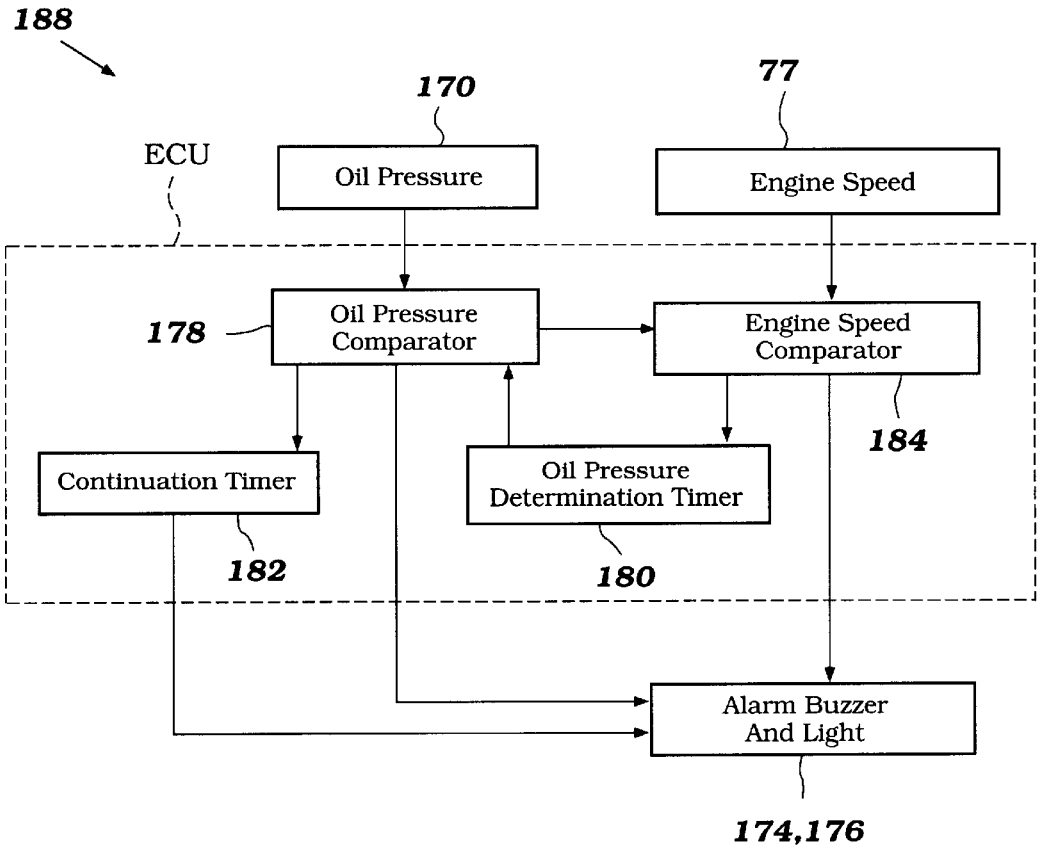
FIG. 7 is a schematic view showing a portion of the engine control system included in the ECU shown in FIG. 6.

During engine operation, ambient air enters the internal cavity 20 defined in the hull 14 through the air ducts 44. As seen in FIGS. 5, 6, and 7, the air is then introduced into the plenum chamber 88 defined by the intake box 84 through the air inlet ports 92 and drawn into the throttle bodies 106. The air filter element 94, which preferably comprises a water-repellent element and an oil resistant element, filters the air. The majority of the air in the plenum chamber 88 is supplied to the combustion chambers 72. The throttle valves 102 in the throttle bodies 106 regulate an amount of the air permitted to pass to the combustion chambers 72. The opening angles of the throttle valves 102, and thus, the airflow across the throttle valves 102, can be controlled by the rider with the throttle lever 34. The air flows into the combustion chambers 72 when the intake valves 82 open. At the same time, the fuel injectors 118 spray fuel into the intake ports 80 under the control of ECU 98. Air/fuel charges are thus formed and delivered to the combustion chambers 72.

The air/fuel charges are fired by the spark plugs 128 under the control of the ECU 98. The burnt charges, i.e., exhaust gases, are discharged to the body of water surrounding the watercraft 10 through the exhaust system 130. A relatively small amount of the air in the plenum chamber 88 is supplied to the exhaust system 130 so as to aid in further combustion of any unburned fuel remaining in the exhaust gases.

The combustion of the air/fuel charges causes the pistons 68 to reciprocate and thus causes the crankshaft 58 to rotate. The crankshaft 58 drives the impeller shaft 56 and the impeller rotates in the hull tunnel 50. Water is thus drawn into the tunnel 50 through the inlet port 52 and then is discharged rearward through the steering nozzle 62. The rider steers the nozzle 62 by the steering handle bar 32. The watercraft 10 thus moves as the rider desires.

With reference now to FIG. 7, a schematic diagram can be seen of an alarm system control system 188. Oil pressure measured by an oil pressure sensor 170, oil temperature measured by an oil temperature sensor 172, as well as an engine speed measured by the engine speed sensor 77 are inputted into the ECU 98. This data is used in various processes in order to determine if and/or when to warn the user of an inadequate oil pressure through an alarm buzzer 174 and alarm light 176. Warning oil pressures are determined through a warning oil pressure determination process 178 from information acquired from an oil pressure determination timer 180 as well as the oil pressure itself. The determined warning oil pressure together with a continuation timer 182 and a critical engine speed determination process 184 trigger the alarm buzzer and light 174, 176 in order to warn the operator of inadequate oil pressure. The operator my stop the engine at any time using an engine stop switch 186.

Figure 12:
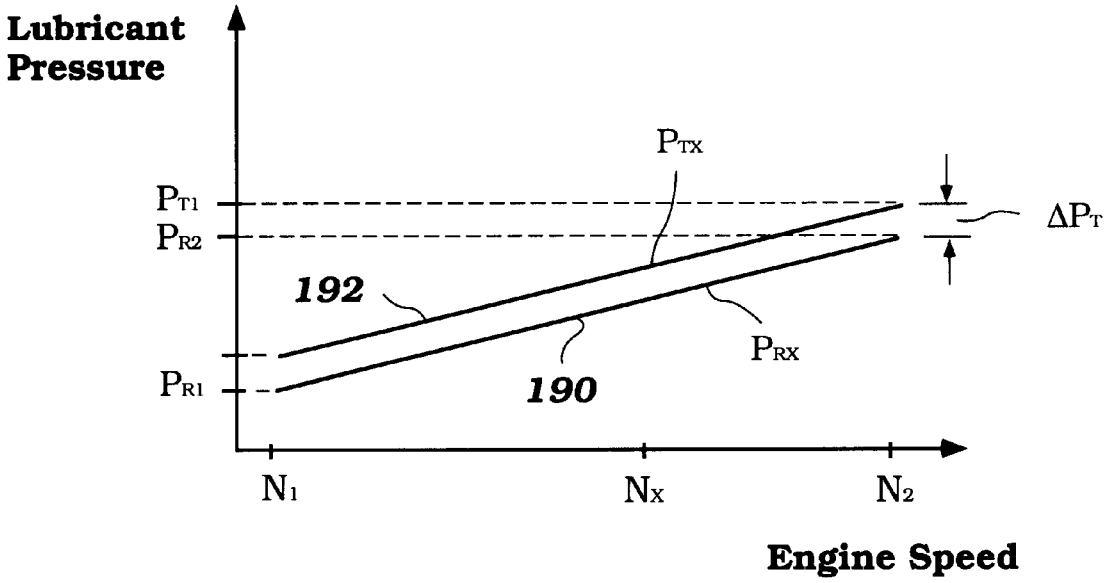
FIG. 12 is a graph showing oil pressure values over time.

FIG. 12 illustrates a map of alarm threshold pressures as a function of engine speed. The vertical axis of the graph of FIG. 12 indicates lubricant pressure and the horizontal axis indicates engine speed. Line 190 of FIG. 12 indicates a minimum lubricant pressure required to protect the engine 12 over the engine speed range $N_1$ to $N_2$. The minimum required pressure at engine speed $N_1$ is a lubricant pressure of $P_{R1}$. The minimum required lubricant pressure at engine speed $N_2$ is $P_{R2}$.

Also shown in FIG. 12 is a line 192 which represents an alarm pressure threshold $P_{TX}$ which is greater than the minimum lubricant pressure required for a particular engine speed. For example, the alarm threshold pressure $P_{T1}$ is greater than the minimum required lubricant pressure $P_{R1}$. Similarly, the alarm pressure threshold $P_{T2}$ at engine $N_2$ is greater than the minimum required lubricant pressure $P_{R2}$.

As shown in FIG. 12, the vertical difference between the minimum required pressure line 190 and the alarm pressure threshold line 192 remains constant along the length of the lines 190, 192 by a distance of $\Delta P_T$. However, it is to be noted that the minimum required pressure line 190 may be represented as a curve according to the lubrication requirements of a particular engine. Additionally, the alarm pressure threshold line 192 may be represented as a curve having a nonuniform offset $\Delta P_T$ from the minimum required lubricant pressure line 190. However, regardless of the shape of the alarm pressure threshold line 192, it is advantageous for the alarm pressure threshold $P_{TX}$ to be greater than the minimum required lubricant pressure $P_{RX}$ for any given engine speed.

Optionally, the alarm control system 188 may be configured to detect an undesirable fluctuation of lubricant pressure in the lubrication system. For example, with reference to FIG. 10, a lubricant pressure fluctuation in the engine 12 is illustrated therein. The graph of FIG. 10 includes a vertical axis indicating lubricant pressure in the engine 12 and the horizontal axis indicates time.

Figure 10:
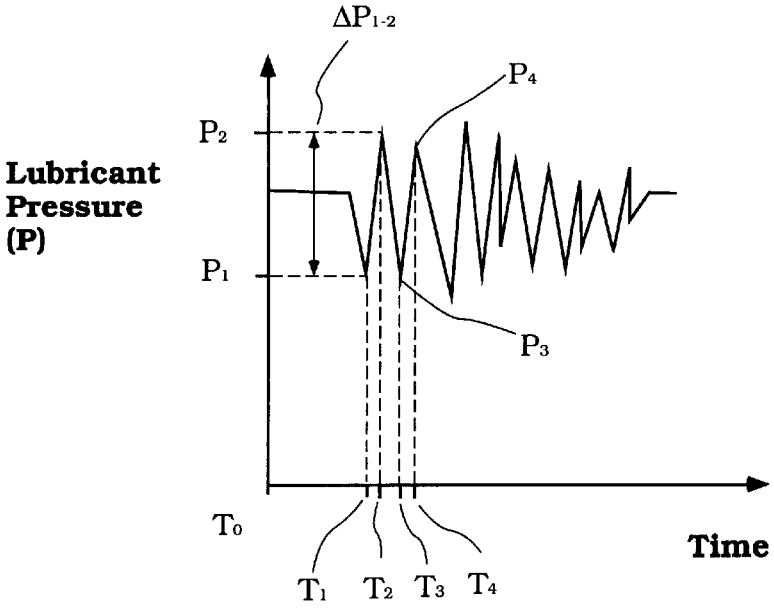
FIG. 10 is a diagram of a graph showing oil pressure characteristics over time.

During operation of the engine 12, lubricant pressure $P_X$ within the engine 12 may fluctuate as a result of the operating conditions. However, certain malfunctions within the engine 12 may cause the lubricant pressure 12 to fluctuate to an undesirable degree. For example, during operation of a watercraft such as the watercraft 10 lubricant may be splashed within the oil reservoir 164 thereby causing air to enter the lubrication system, which interrupts a flow of lubricant through the lubrication system. As air bubbles travel through the various engine galleries and conduits within the engine 12, the lubricant pressure within the engine 12 will fluctuate. For example, as shown in FIG. 10, as air bubbles pass by the lubricant pressure sensor 170, the lubricant pressure $P_X$ sensed by the lubricant pressure sensor 170 will fluctuate rapidly over time. Additionally, as the air travels through the lubrication system, various components of the engine 12 may be inadequately lubricated. Thus, the alarm control system 188 is desirably configured to detect undesirable fluctuations in the lubricant pressure $P_X$ which may be indicative of inadequate lubrication within the engine 12.

As shown in FIG. 10, the fluctuation in lubricant pressure $P_X$ within the engine 12 is sensed by lubricant pressure sensor 170 over time. For example, at time $T_1$ the lubricant pressure sensor 170 detects a lubricant pressure $P_1$ in the engine 12. Subsequently, the lubricant pressure sensor 170 senses lubricant pressure $P_2$ at time $T_2$, pressure $P_3$ at time $T_3$, and lubricant pressure $P_4$ at time $T_4$. Each fluctuation $\Delta P_F$ is defined as the absolute value of the difference from a current lubricant pressure $P_X$ to a previous detected lubricant pressure $P_{(X-1)}$. For example, a pressure fluctuation $\Delta P_F$ from time $T_1$ to time $T_2$ would be the absolute value of the difference of $P_2$ and $P_1$, i.e., $$|P_2-P_1|=\Delta P_F$$

It is to be noted that during normal operation of the engine 12, there will be acceptable fluctuations in lubricant pressure. However, it is preferable that the alarm control system 188 is configured to detect and respond to pressure fluctuations above the predetermined pressure fluctuation alarm threshold $\Delta P_A$.

Thus, the predetermined pressure fluctuation alarm threshold $\Delta P_A$ is set at a pressure difference which would be indicative of inadequate lubricant flow in the engine 12, such as for example but without limitation, pressure fluctuations caused by air flowing through the lubrication system in the engine 12. Thus, if a pressure fluctuation occurs in the lubrication system, the alarm control system 188 may initiate an alarm, or may record the fluctuation for further computations.

For example, the oil pressure comparator 178, or another separate comparator (not shown) may be configured to compare a present lubricant pressure $P_X$ with a previous lubricant pressure $P_{(X-1)}$. The oil pressure comparator 178 may calculate the absolute value of the difference between lubricant pressure $P_X$ and lubricant pressure $P_{(X-1)}$. For example, the oil pressure comparator 178, with reference to FIG. 9, may calculate the absolute value of the difference between lubricant pressure $P_1$ and lubricant pressure $P_2$ as pressure fluctuation $\Delta P_{1-2}$. If the pressure fluctuation $\Delta P_{1-2}$ is greater than a predetermined pressure alarm threshold $\Delta P_A$, the oil pressure comparator 178 records data indicating a pressure fluctuation greater than the predetermined pressure fluctuation threshold $\Delta P_A$ has been exceeded at a time corresponding to the fluctuation, i.e., $\Delta P_{1-2}$.

Preferably, the oil pressure comparator 178, or another component (not shown) of the alarm control system 188 tallies the number of pressure fluctuations which exceed the predetermined pressure fluctuation alarm threshold $\Delta P_A$ over a period of time and records the number of such fluctuations as $F_P$.

Preferably, the oil pressure comparator 178, or another component of the alarm control system 188, compares the number of unacceptable pressure fluctuations $F_P$ with the predetermined pressure fluctuation rate threshold $F_{PT}$. The predetermined pressure fluctuation rate threshold $F_{PT}$ indicates the maximum number of unacceptable pressure fluctuations that may occur for a predetermined period of time. For example, the pressure fluctuation threshold may be set at a rate such as two per second, for example. Thus, if the alarm control system 188 detects more than two unacceptable pressure fluctuations in one second, the alarm control system 188 emits an alarm.

For example, if the oil pressure comparator 178 detects three unacceptable pressure fluctuations in one second, i.e., $F_P=3$, where the predetermined pressure fluctuation rate threshold $F_{PT}=2$, the oil pressure comparator 178 will signal an alarm 174,176.

The oil pressure comparator 178 may be a comparator, a calculator, a logic circuit board or the like. The illustrated embodiment features visual alarms, auditory alarms, and disabling arrangements. Of course, tactile alarms and other alarms suitable to transmit information regarding an undesirable characteristic of engine performance may be used. Visual alarms may include, without limitation, lights and gauges. Auditory alarms may include, without limitation, buzzers, bells, sirens, and the like. Disabling arrangements may, as will be recognized, selectively disable combustion within selected combustion chambers in order to slow engine speed or completely stop engine operation in any suitable manner.

Figure 8:
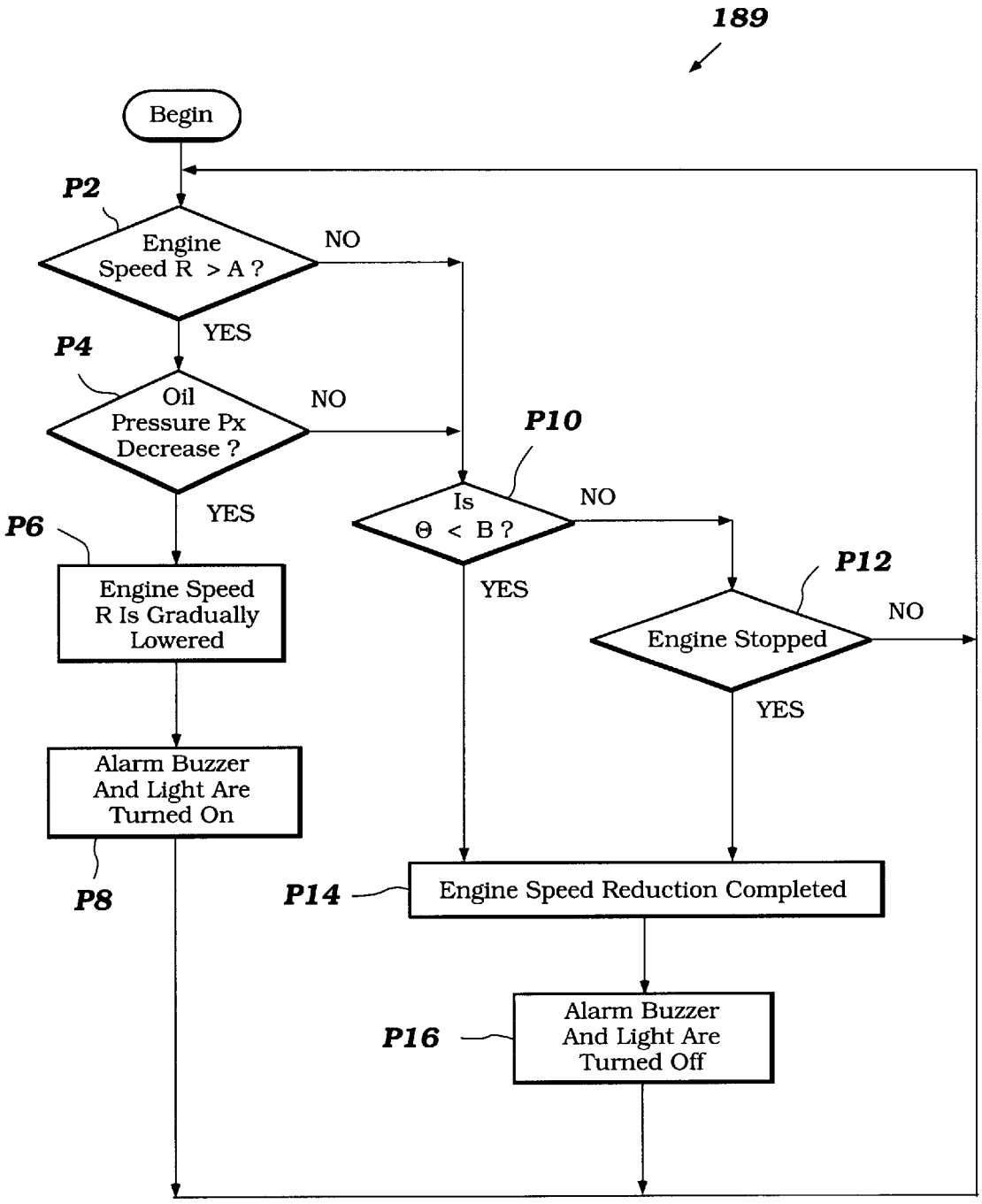
FIG. 8 is a block diagram showing a control routine arranged and configured in accordance with certain features, aspects and advantages of the present invention.

FIG. 8 shows a control routine 189 is shown that is arranged and configured in accordance with certain features, aspects and advantages of the present invention. The control routine 189 begins and moves to a first decision block P2 in which the engine speed R is compared to a predetermined engine pre-planing speed A (e.g., A can be about 3000–5000 RPM in some applications). Preferably, the predetermined engine pre-planing speed is an engine speed that generally corresponds to a watercraft speed that places the watercraft in the transition mode. If the speed is greater than A, the routine proceeds to a decision block P4. If, however in decision block P2 the engine speed is determined not to be greater than A, the control routine 189 moves to decision block P10.

In decision block P4 it is determined if an oil pressure decrease has occurred. This oil pressure decrease is determined by the ECU 98 by comparing the present oil pressure with the alarm pressure threshold $P_{TX}$ depending on engine speed as seen in FIG. 12.

In decision block P4 if there is no oil pressure decrease, the control routine 189 moves to decision block P10, where as explained in the previous paragraph, it is determined if a throttle angle Θ is less than a predetermined throttle angle B. If, however in decision block P4 there is an oil pressure decrease, the control routine 189 moves to operation block P6.

In operation P6, the engine speed R is gradually lowered. This gradual lowering of the engine speed is accomplished by decreasing the fuel injection to the engine or by retarding the ignition timing.

The control routine 189 then moves to operation block P8 where the alarm buzzer and light are activated to warn the operator of an inadequate oil pressure. The control routine 189 then returns to the beginning and repeats.

In decision block P10 it is determined if a throttle angle Θ is less than a predetermined throttle angle B. The throttle angle B can be a value representing an angle between 0–3 degrees in order to accurately represent an idle position of the throttle valve. If the throttle angle Θ is less than a predetermined throttle angle B, the control routine 189 moves to operation block P14.

In operation block P14 the engine speed reduction is completed. The engine speed completion assures that proper operation is restored once the engine is receiving the proper oil pressure. Letting the throttle angle reach a resting idle position before the engine speed reduction is completed allows for a smooth, operator friendly return to full engine power instead of an abrupt return of engine speed and power.

The control routine 189 then moves to operation block P16 where the alarm buzzer and light are turned off. The control routine 189 then returns to the beginning and repeats.

If, in decision block P10 the throttle angle Θ is not less than a predetermined throttle angle B, the control routine 189 moves to decision block P12.

In decision block P12 it is determined if the engine has stopped. If in decision block P12 it is determined that the engine has not stopped, the control routine 189 returns to the beginning and repeats.

In decision block P12 it is determined that the engine has stopped, the control routine 189 moves to P14 where the engine speed reduction is completed.

The control routine 189 then moves to operation block P16 where the alarm buzzer and light are turned off. The control routine 189 then returns to the beginning and repeats.

Figure 9:
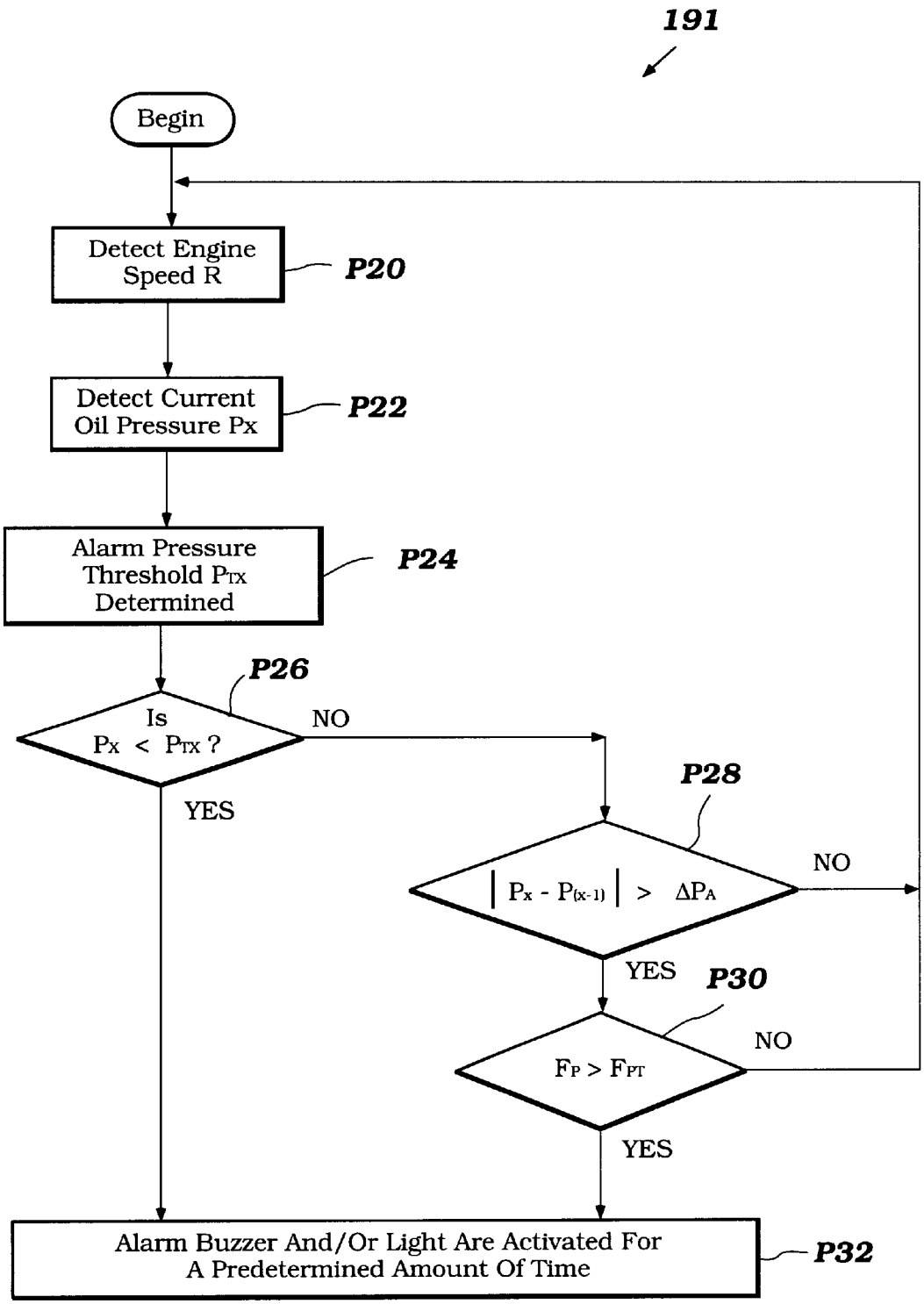
FIG. 9 is a block diagram showing another control routine arranged and configured in accordance with certain features, aspects and advantages of the present invention.

With reference now to FIG. 9, a control routine 191 is shown that is arranged and configured in accordance with certain features, aspects and advantages of the present invention. The control routine 191 begins and moves to a first operation block P20 where the engine speed R is measured. The engine speed R may be measured using a variety of different methods including a crankshaft speed sensor 77. The control routine 191 then moves to operation block P22.

In operation block P22 the current oil pressure PX is measured. The oil pressure PX may be measured using a variety of different methods including the oil pressure sensor 170. The control routine 191 then moves to operation block P24.

In operation block P24 the correct alarm pressure threshold $P_{TX}$ is determined based on engine speed as shown in FIG. 12. The correct alarm pressure threshold $P_{TX}$ is determined using a variety of different variables including, but not limited to engine speed and oil temperature. The control routine 191 then moves to decision block P26.

In decision block P26 it is determined if the actual oil pressure Px is less than the predetermined alarm pressure threshold $P_{TX}$. If the actual oil pressure Px is less than the predetermined alarm pressure threshold $P_{TX}$, the control routine 191 moves to operation block P32 where the alarm buzzer and light are activated for a predetermined amount of time to accurately warn the user of inadequate oil pressure.

If, however in decision block P26 the actual oil pressure P is not less than the predetermined alarm pressure threshold $P_{TX}$, the control routine 191 moves to decision block P28.

In decision block P28 it is determined if the actual oil pressure PX has changed from a previously detected PX by a predetermined value. This decision block is clarified by referring to FIG. 10 where a graph is shown of the fluctuations of actual oil pressure with reference to time. Oil pressure fluctuation can be the result of air entering the lubrication system through the oil pump during watercraft operation when the oil reservoir amount is lower than a predetermined minimum amount.

If in the decision block P28 the actual oil pressure PX has not changed from a previously detected actual oil pressure by a certain value, the control routine 191 returns to the beginning and repeats. If, however the actual oil pressure PX has changed from a previously detected oil pressure by a certain value, the control routine 191 moves to decision block P30.

In decision block P30 it is determined if the number of pressure changes Fp are greater than a predetermined number of inadequate oil pressure warnings Fpt. The pressure changes compared in decision block P30 may be caused by fluctuations in oil pressure due to air entering the system. A fluctuating oil pressure situation is illustrated in FIG. 10.

If the number of pressure changes are greater than a predetermined number of inadequate oil pressure warnings then the control routine 191 moves to operation block P32 where the alarm light and buzzer are turned on to warn the operator of inadequate oil pressure.

If, however in decision block P30 it is determined that the number of pressure changes are not greater than a predetermined number of inadequate oil pressure warnings the control routine 191 returns to the beginning and repeats.

Figure 11:
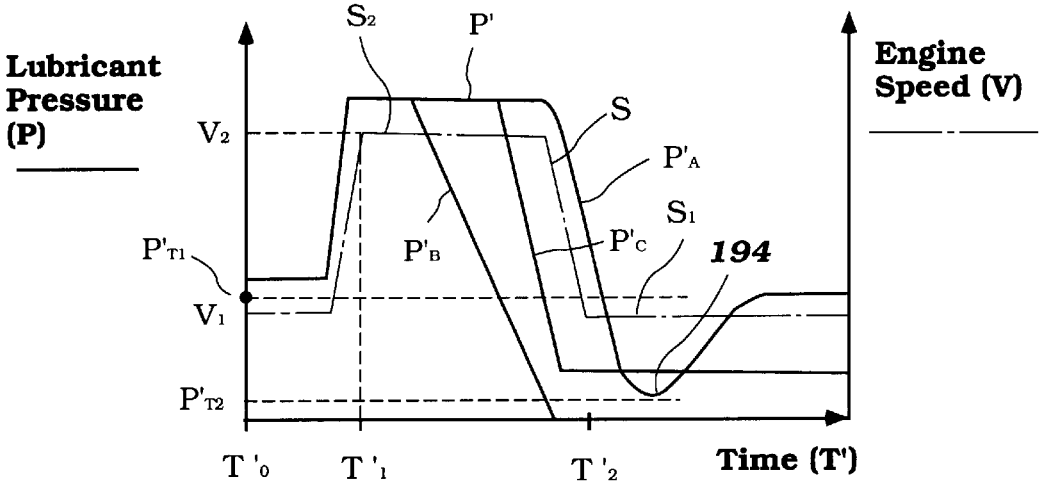
FIG. 11 is a diagram of a graph showing oil pressure with respect to various engine speeds over time.

The graph of FIG. 11 illustrates an example of engine speed fluctuation. The engine speed of the engine 12 starts at $V_1$ at time $T_0'$, increases to engine speed $S_2$ at time $T_1'$, and returns to speed $S_1$ at time $T_2'$. When the lubrication system of a conventional outboard motor is operating properly, the lubricant pressure P' increases and decreases proportionally with engine speed V. However, due to the viscous nature of lubricant, the pressure of lubricant does not vary as rapidly as engine speed. For example, as shown in FIG. 11, the curve labeled as $P'_A$ indicates the lubricant pressure within an outboard motor which is operating properly. Thus, as shown in FIG. 11, lubricant pressure $P'_A$ increases as the engine speed increases from engine speed $S_1$ to $S_2$ and decreases again as the engine speed drops from engine speed $S_2$ to engine speed $S_1$. However, due to the nature of lubricants such as oil, the lubricant pressure $P'_A$ drops to a minimum point 194 before rising again to a proper lubricant pressure appropriate for the engine speed $S_1$.

In certain conventional outboard motors, lubricant pressure alarms have been calibrated to emit an alarm if the lubricant pressure drops below a pressure $P'_{T1}$. However, since under normal operation, lubricant pressure within an outboard motor may drop below this threshold down to a minimum point 194 during normal operation, such conventional outboard motors may erroneously emit an alarm when no malfunction is actually present. Thus, other conventional outboard motors have been known to include alarms which are calibrated to emit an alarm only when the lubricant pressure within the engine drops below a pressure $P'_{T2}$ which is lower than $P'_{T1}$, thus avoiding the emission of an alarm when the lubricant pressure in the outboard motor drops to a minimum point, such as minimum point 194.

However, one aspect of the present invention involves a realization that lubrication system alarms which only operate so as to emit an alarm when the lubricant pressure within the engine drops below a single predetermined threshold suffer from the drawback that other unacceptable pressure fluctuations may not trigger the lubricant pressure alarm. For example, FIG. 11 illustrates an lubricant pressure drop along line $P'_B$ where the lubricant pressure in an engine drops rapidly from a normal lubricant pressure along line $P'_A$ to zero. In this case, an alarm would be sounded in an outboard motor which uses a predetermined alarm threshold pressure $P'_{T1}$ or $P'_{T2}$. However, the alarm would not be emitted until lubricant pressure P' drops below the corresponding thresholds. Thus, for the time period while the lubricant pressure is dropping along line $P'_B$, the engine will be inadequately lubricated and suffer damage. Additionally, if the lubrication system of the engine experiences a partial lubricant pressure reduction such as illustrated by the line $P'_C$, the lubricant pressure alarm may not be triggered at all.

For example, with a lubricant pressure alarm set at the threshold $P'_{T2}$, a pressure drop along the line $P'_C$would not trigger the corresponding alarm. Finally, if a lubricant pressure within an outboard motor fluctuates similarly to the fluctuation illustrated in FIG. 10, without extending below the pressure thresholds $P'_{T1}$ or $P'_{T2}$ illustrated in FIG. 11, those corresponding alarms would not be triggered, despite the inadequate flow of lubricant through the engine.

Thus, by constructing the lubricant pressure alarm control system 188 in accordance with the present invention, undesirable reductions in lubricant pressure within the engine 12 are more accurately identified and an operator is informed more readily regarding undesirable lubricant pressures within the engine, thus enhancing the durability and lifespan of the engine 12.

Figure 13:
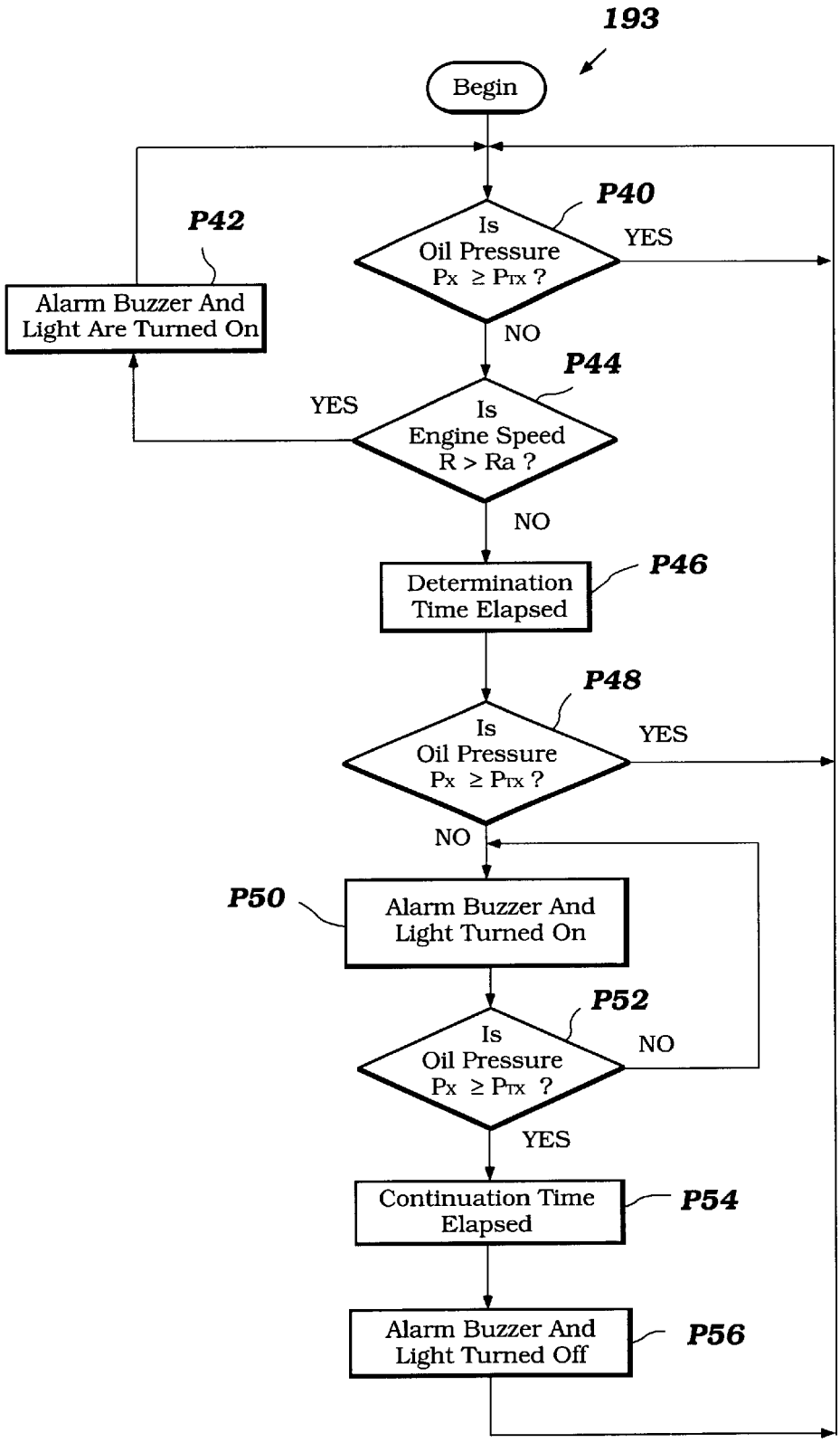
FIG. 13 is a block diagram showing another control routine.

With reference now to FIG. 13, a control routine 193 is shown that is arranged and configured in accordance with certain features, aspects and advantages of the present invention. The control routine 193 begins and moves to a first decision block P40 where it is determined if the actual oil pressure Px is greater than or equal to the predetermined alarm pressure threshold $P_{TX}$. The warning oil pressure Px is determined using a variety of different variables including, but not limited to engine speed as shown in FIG. 12. If the actual oil pressure Px is greater than or equal to the predetermined alarm pressure threshold $P_{TX}$, the control routine 193 returns to the beginning and repeats.

If, however the actual oil pressure Px is not greater than or equal to the predetermined alarm pressure threshold $P_{TX}$, the control routine 193 moves to decision block P44 where the actual engine speed R is compared to a predetermined warning speed Ra. The predetermined warning speed represents the lowest speed of the engine where enough oil pressure is produced, (for example Ra <1000 rpm).

If the actual speed R is greater than the predetermined warning speed Ra, then the control routine 193 moves to operation block P42 where the alarm and buzzer are turned on. From operation block P42 the control routine 193 returns to the beginning and repeats. If the actual speed R is not greater than the predetermined warning speed Ra, then the control routine 193 moves to operation block P46 where a determination time is allowed to elapse. The determination time is the time needed in order to evaluate a correct oil pressure value. The control routine 193 then moves to decision block P48.

In decision block P48 the actual oil pressure Px is again compared to the predetermined alarm pressure threshold $P_{TX}$. If the actual oil pressure Px is greater than or equal to the predetermined alarm pressure threshold $P_{TX}$ then the control routine 193 returns to the beginning and repeats. If, however in decision block P48 the actual oil pressure Px is not greater than or equal to the predetermined alarm pressure threshold $P_{TX}$, the control routine 193 moves to operation block P50 where the alarm buzzer and light are activated. The control routine 193 then moves to decision block P52.

In decision block P52 the actual oil pressure Px is again compared to the predetermined alarm pressure threshold $P_{TX}$. If the actual oil pressure P is not greater than or equal to the predetermined alarm pressure threshold $P_{TX}$, the control routine 193 returns to operation block P50. If, however the actual oil pressure Px is greater than or equal to the predetermined alarm pressure threshold $P_{TX}$, the control routine 193 moves to operation block P54.

In operation block P54 a continuation time is allowed to elapse. The continuation timer allows the activated alarm to remain active for a predetermined amount of time. Once this predetermined amount of time elapses, the control routine 193 moves to operation block P56.

In operation block P56 the alarm buzzer and light are turned off letting the operator know that the oil pressure has resumed to a safe value. The control routine 193 then returns to the beginning and repeats.

Figure 14:
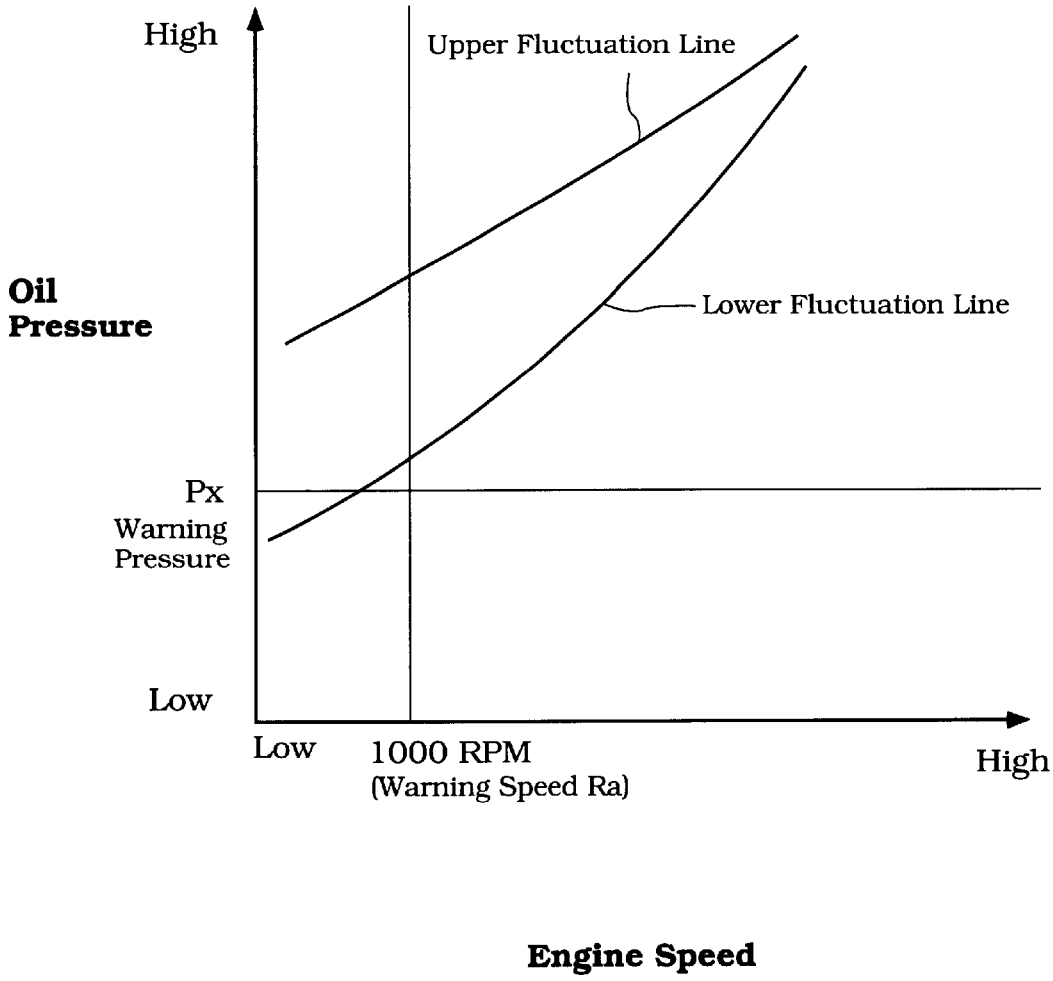
FIG. 14 is a diagram of a graph showing oil pressure fluctuations with respect to engine speed.

FIG. 14 is a diagram showing oil pressure with reference to engine speed. The diagram illustrates an upper oil pressure fluctuation line and a lower oil pressure fluctuation line between which the oil pressure value of the engine is found. The predetermined warning speed Ra can also be seen.

It is to be noted that the control systems described above may be in the form of a hard wired feedback control circuit in some configurations. Alternatively, the control systems may be constructed of a dedicated processor and memory for storing a computer program configured to perform the steps described above in the context of the flowcharts. Additionally, the control systems may be constructed of a general purpose computer having a general purpose processor and memory for storing the computer program for performing the routines. Preferably, however, the control systems are incorporated into the ECU 110, in any of the above-mentioned forms.

Although the present invention has been described in terms of a certain preferred embodiments, other embodiments apparent to those of ordinary skill in the art also are within the scope of this invention. Thus, various changes and modifications may be made without departing from the spirit and scope of the invention. For instance, various steps within the routines may be combined, separated, or reordered. In addition, some of the indicators sensed (e.g., engine speed and throttle position) to determine certain operating conditions (e.g., rapid deceleration) can be replaced by other indicators of the same or similar operating conditions. Moreover, not all of the features, aspects and advantages are necessarily required to practice the present invention. Accordingly, the scope of the present invention is intended to be defined only by the claims that follow.

What is claimed is:

1. A method of controlling operation of an engine having an engine body, a lubrication system circulating lubricant through the engine body, and an engine load input device operable by an operator of a watercraft, the method comprising operating the engine in accordance with a position of the engine load input device, detecting a pressure within the lubrication system, detecting a speed of the engine, decreasing the speed of the engine to a first engine speed if the lubricant pressure is below a predetermined pressure, and limiting the engine speed to the first engine speed after the pressure in the lubrication system rises above the predetermined pressure, until the engine load input device is moved to a position corresponding to an engine load that is below a predetermined engine load.

2. The method according to claim 1, wherein the engine load input device is a throttle lever.

3. The method according to claim 1, wherein the engine load is represented by the position of a throttle valve.

4. The method according to claim 3, wherein the engine load input device is in direct communication with the throttle valve.

5. An engine comprising an engine body, an engine load input device, a lubrication system configured to circulate lubricant through the engine body, a lubricant pressure sensor configured to detect a pressure within the lubrication system, an engine speed sensor configured to detect a speed of the engine, and a controller configured to limit engine speed to a first engine speed when the engine load input device is in a first position corresponding to an engine load above a first predetermined engine load if the lubricant pressure falls below a predetermined pressure, the controller being configured to continue to limit the engine speed to the first engine speed after the lubricant pressure rises above the predetermined pressure and until the engine load input device is moved to a position corresponding to an engine load that is below the first predetermined engine load.

6. The engine as set forth in claim 5, wherein the engine load input device is a throttle lever.

7. The engine as set forth in claim 5, wherein the engine load is represented by the position of a throttle valve.

8. The engine as set forth in claim 7, wherein the engine load input device is in direct communication with the throttle valve.

9. A watercraft comprising a hull, a straddle type seat positioned on an upper portion of the hull, and an engine disposed within the hull, the engine having an engine body defining at least one combustion chamber therein, a fuel delivery system configured to deliver fuel to the engine body for combustion within the combustion chamber, a lubrication system configured to circulate lubricant through the engine body, a lubricant pressure sensor configured to detect a pressure within the lubrication system, an engine speed sensor configured to detect a speed of the engine, and a controller connected to the lubricant pressure sensor, the engine speed sensor, and the fuel delivery system, the controller being contigured to gradually reduce the speed of the engine if the lubricant pressure is below a predetermined pressure.

10. The watercraft as set forth in claim 9, wherein the engine is positioned below the straddle type seat.

11. A method of controlling operation of a watercraft engine having a throttle lever as an engine load input device and a lubrication system, the method comprising determining an engine load by determining a position of a throttle valve, determining a pressure within the lubrication system, and determining if the pressure is less than a predetermined pressure, triggering an abnormal lubricant pressure operation mode in which the engine speed is gradually reduced.

12. The method according to claim 11, wherein the engine load input device is in direct communication with the throttle valve.

13. A watercraft comprising a hull, a straddle type seat positioned on an upper portion of the hull, an engine disposed within the hull, a lubrication system configured to circulate lubricant through the engine, a lubricant pressure sensor configured to detect a pressure within the lubrication system, an engine speed sensor configured to detect a speed of the engine, a controller configured to decrease engine speed if the lubricant pressure is below a predetermined pressure, and an engine load input device, the controller being configured to continue to operate the engine at a reduced engine speed until the engine load input device is moved to a position corresponding to an engine load that is below a predetermined engine load.

14. The watercraft as set forth in claim 13, wherein the engine is positioned below the straddle type seat.

15. A watercraft comprising a hull, an engine disposed within the hull, a lubrication system configured to circulate lubricant through the engine, a lubricant pressure sensor configured to detect a pressure within the lubrication system, an engine speed sensor configured to detect a speed of the engine, a controller configured to decrease engine speed if the lubricant pressure is below a predetermined pressure, and an engine load input device comprising a throttle lever, the controller being configured to determine the engine load based on a position of a throttle valve, the controller being configured to continue to operate the engine at a reduced engine speed until the engine load input device is moved to a position corresponding to an engine load that is below a predetermined engine load.

16. The watercraft as set forth in claim 15, wherein the engine load input device is in direct communication with the throttle valve.

17. A method of controlling operation of a watercraft engine having a lubrication system and an engine load input device comprising a throttle lever, the method comprising determining an engine load based on a position of a throttle valve, determining if a pressure in the lubrication system is below a predetermined pressure, reducing a speed of the engine if the lubricant pressure is below the predetermined pressure, and restoring normal operation of the engine if the engine loaded input device is returned to a position corresponding to an engine load below a predetermined engine load.

18. The method according to claim 17, wherein the engine load input device is in direct communication with the throttle valve.

* * * * *